United States Patent [19]

Roach et al.

[11] 4,095,449

[45] Jun. 20, 1978

[54] COATED PUNCH

[75] Inventors: Frank George Roach, Rochester; Paul Fred Woerner, Grosse Pointe, both of Mich.

[73] Assignee: The Valeron Corporation, Detroit, Mich.

[21] Appl. No.: 755,672

[22] Filed: Dec. 30, 1976

Related U.S. Application Data

[63] Continuation of Ser. No. 585,297, Jun. 9, 1975, abandoned.

[51] Int. Cl.[2] ..... B21C 25/00

[52] U.S. Cl. ..... 72/273; 72/467

[58] Field of Search ..... 72/273, 467, 468; 76/101 B, 107 R, 107 A

[56] References Cited

U.S. PATENT DOCUMENTS

| | | | |
|---|---|---|---|
| 1,637,111 | 7/1927 | Honig | 76/107 A |
| 1,708,715 | 4/1929 | Akin | 76/107 A |
| 2,753,261 | 7/1956 | Goetzel et al. | 72/467 X |
| 3,177,084 | 4/1965 | Amstein | 72/467 X |
| 3,230,759 | 1/1966 | Schoenfeld et al. | 72/467 |
| 3,807,212 | 4/1974 | Lawson | 72/467 X |

FOREIGN PATENT DOCUMENTS

| | | | |
|---|---|---|---|
| 1,289,730 | 9/1972 | United Kingdom | 72/467 |
| 1,390,035 | 4/1975 | United Kingdom | 72/467 |

*Primary Examiner*—E. M. Combs

[57] ABSTRACT

A punch used for extruding tin plated cans consisting of a cemented tungsten carbide punch body coated with a thin layer of titanium nitride.

7 Claims, No Drawings

COATED PUNCH

This is a continuation of application Ser. No. 585,297, filed June 9, 1975, abandoned.

BACKGROUND OF THE INVENTION

This invention relates to extrusion tooling and especially to punches used for extruding the main body of a conventional tin plated steel can.

The can manufacturing industry has been using punches made of cemented tungsten carbide for such extrusion. These punches are relatively expensive and have been found to have a limited useful life. Limited punch life is due to pitting in the highly polished punch surface.

Pitting occurs during use of the punches where it is caused by etching or leaching of the binder in the tungsten carbide. Carbide grades used in the punches generally contain either cobalt or nickel binders. The cobalt or nickel at the punch surface is leached or etched during the extrusion process by the coolant used to keep the extrusion temperatures down. Cobalt is generally leached at a faster rate than nickel. Also, certain reactive inclusions on the surface of the punch may be attacked by the coolant. The surface pits gradually accumulate tin from the cans, most probably by alloying of the liquid tin phase with the binder phase of a tungsten carbide. The build-up eventually extends beyond the punch surface, making removal of the can difficult and impairing the qualify of the finished can by scoring the surface when the can is removed. On occasion the can will not be cleanly removed leaving all or a portion of the can adhering to the punch causing major damage to the tooling and machine on the next cycle.

The pitting and resultant build-up usually becomes excessive when between 200,000 and 400,000 cans have been produced. In some cases build-up becomes excessive after as few as 30,000 cans. At that point, the punch is removed to be repolished. The repolishing removes the tin build-up but does not remove the pits. After several repolishing operations a punch may be undersize or so severely pitted that it must be discarded.

The pitting problem is also encountered in the manufacture of the punches prior to use. Pits here can be caused by inclusions in the metal which fall or are knocked out of the surface during finishing operations. Pits can also result from incomplete densification in pressing and sintering operations. Inherent surface porosity of the sintered carbide material has made it necessary to hot isostatically press most punches after sintering and before finish grinding to assure that required surface conditions can be achieved. Even with hot isostatic pressing, it is not uncommon for a significant percentage of punches to be rejected for production use due to surface pitting.

In some can manufacturing operations steel punches are used to extrude tin plated steel cans in which case the leaching or etching of a binder causing pitting is not involved. However, under the heat developed in the extruding operation metal transfer occurs between the steel of the cans and the punch causing a gradual welded build-up of can steel on the punch which in turn causes galling and frequent requirements for punch refinishing.

SUMMARY OF THE INVENTION

According to this invention, punches and optionally other elements of extrusion tooling such as die rings, are coated with a thin layer of titanium nitride or a nitride of another material selected from the group consisting of tantalum, columbium, hafnium and silicon. This coating serves as a barrier to protect the cemented carbide binder from etching or leaching, and in addition, has been found to provide greater lubricity for ease of can removal after extrusion. Also, this coating may be used to reclaim rejected or otherwise unusable pitted punches as the coating will fill in or coat the pits. The coating may further serve to increase the size of otherwise undersize punches.

In the case of steel punches, the nitride coating is inert and does not chemically react or weld with the can steel.

DESCRIPTION OF THE PREFERRED EMBODIMENT

Extrusion punches used in the manufacture of two-piece tin-plated steel beverage cans are generally cylindrical in shape, 2 to 3 inches in diameter and 5 to 8 inches in length. The lead end of the punches is tapered slightly and slightly varying diameter may be used along the length of the punch.

The punch body is manufactured from tungsten carbide in a conventional manner by green pressing carbide powder into a preform billet, machining the billet to form the punch and then sintering the punch in a furnace. The sintered punch is then hot isostatically pressed. In accordance with the present invention, the outside surface of the punch is then ground slightly undersize (preferably 0.0004 inch in diameter) to allow for the application of the coating.

A coating of titanium nitride is applied to the outside surface of the punch body by a suitable conventional process, such as chemical vapor deposition, sputtering or ion plating. The titanium nitride coating is metallurgically bonded to the body surface and is chemically compatible while having desirable thermal expansion properties. More importantly, it is not possible to form solid inclusions in the coating due to the nature of the coating process used in applying the nitride. This is not the case with a refractory carbide coating such as titanium carbide, or tungsten carbide, because in depositing the carbide, a hydrocarbon is used and it is possible that free carbon can be deposited as an inclusion as the hydrocarbon undergoes pyrolysis. With titanium nitride, the coating is finer grained and free of solid inclusions. The coating is preferably applied to provide a film thickness in the order of 0.0004 to 0.0006 inch. The metallurgically bonded film coating of the present invention is specifically directed and limited to a coating which may be conventionally applied by chemical vapor deposition, sputtering, ion plating or suitable equivalent process. After the coating is applied, the punch is ground and polished with the thickness of the coating after finishing being in the order of 0.00015 to 0.0003 inch with a 0.0002 inch uniform coating being preferred.

The advantages of the titanium nitride coated punches include elimination of etching or leaching of the binder phase, protection of the surface from corrosion, elimination of problems associated with surface inclusions, surprising remarkably increased punch life, reduced frictional force between can and punch during extrusion as well as during can removal, and maintenance of punch body strength. In addition, extrusion press down time is minimized and the expense of multiple repolishing operations is greatly reduced. A test punch, according to this invention, has already produced over 1,000,000 cans (more than double the normal maximum) in a test operation without showing any signs of surface pitting. It has never been removed from the machine for re-working. The test punch has a sintered tungsten carbide body (with cobalt binder) and a 0.0002 inch thick coating of titanium nitride. All cans have been easily removed from the punch by normal means and there has been no scoring of the cans.

Punches according to this invention can be used in other extrusion processes where pitting occurs and there is a material affinity between the punch and the extruded product or the coolant fluid. Also, other extrusion tooling, such as the die pieces or rings used in conjunction with the punches in the can extrusion process, can also be made according to the invention with a thin coating of titanium nitride. In certain circumstances, the coating may eliminate the need for hot isostatic pressing to eliminate porosity and make possible the use of punches with a reduced allowance of stock for finish grind due to a reduction in the criticality of surface finish when the coating is used.

While a titanium nitride coating is preferred for commercial economic reasons, substitution of a nitride of another material from the aforementioned group may be resorted to with similar results.

In the case of steel punches, a somewhat thinner coating as low as 0.0001 inch may suffice preferably applied by sputtering or ion plating to avoid adverse surface heating effects of chemical vapor deposition.

We claim:

1. Extrusion tooling comprising an appropriately shaped tool body with a metallurgically bonded film coating of a nitride of a material selected from the group of titanium, tantalum, columbium, hafnium and silicon applied to the forming surface of the tool body, said film coating having a thickness in the order of 0.00015–0.0003 inches.

2. The tooling of claim 1 wherein said tool body is made of cemented tungsten carbide.

3. The tooling of claim 2 wherein the coating has a thickness range in the order of 0.00010 to 0.0003 inch.

4. The tooling of claim 2 wherein the coating has a uniform thickness of approximately 0.0002 inch.

5. The tooling of claim 2 wherein the coating is titanium nitride.

6. The tooling of claim 1 wherein said tool body is made of steel.

7. The tooling of claim 1 wherein said tool body is a male punch.

* * * * *